United States Patent [19]

Witting

[11] 4,117,374

[45] Sep. 26, 1978

[54] FLUORESCENT LAMP WITH OPPOSING INVERSERE CONE ELECTRODES

[75] Inventor: Harald L. Witting, Burnt Hills, N.Y.

[73] Assignee: General Electric Company, Schenectady, N.Y.

[21] Appl. No.: 882,105

[22] Filed: Feb. 28, 1978

Related U.S. Application Data

[63] Continuation of Ser. No. 753,771, Dec. 23, 1976, abandoned.

[51] Int. Cl.[2] ..... H01J 1/16; H01J 61/09

[52] U.S. Cl. ..... 315/99; 313/493; 313/186; 313/212; 313/217; 313/339; 313/356; 313/220

[58] Field of Search ..... 315/100, 99, 105, 246, 315/DIG. 5; 313/217, 356, 212, 339, 491, 492, 493

[56] References Cited

U.S. PATENT DOCUMENTS

| | | | |
|---|---|---|---|
| 2,009,839 | 7/1935 | Found | 313/212 X |
| 2,314,134 | 3/1943 | Eknayan | 313/212 X |
| 2,443,121 | 6/1948 | Smith | 313/212 X |
| 2,479,529 | 8/1949 | Watrous, Jr. et al. | 313/207 X |
| 2,915,664 | 12/1959 | Lemmers | 313/493 |
| 3,504,218 | 3/1970 | Emidy et al. | 313/212 |
| 3,657,590 | 4/1972 | Johnson | 313/227 X |
| 3,657,591 | 4/1972 | Johnson | 313/227 X |
| 3,883,764 | 3/1975 | Johnson et al. | 313/212 |

*Primary Examiner*—Alfred E. Smith
*Assistant Examiner*—Charles F. Roberts
*Attorney, Agent, or Firm*—Lawrence D. Cutter; Joseph T. Cohen; Marvin Snyder

[57] ABSTRACT

Electrodes for high current electric discharges in low pressure gases comprise a heated filament, coated with emissive material and surrounded by a hollow emitting surface in the shape of a truncated cone. The electric discharge initially starts from a spot on the filament and transfers to a diffuse mode at the small end of the cone structure.

High current fluorescent lamps which include the electrodes of the present invention are characterized by rapid transition from the spot mode to the diffuse mode discharge and by low cathode fall voltage.

14 Claims, 3 Drawing Figures

FLUORESCENT LAMP WITH OPPOSING INVERSERE CONE ELECTRODES

This is a continuation of application Ser. No. 753,771, filed Dec. 23, 1976, now abandoned.

This invention relates to electrodes for use in electric discharge lamps. More specifically, this invention relates to hollow electrodes which are adapted for use in a high current, low pressure environment and characterized by internal heated filaments and a generally conical external structure.

BACKGROUND OF THE INVENTION

There is considerable interest in reducing the length of fluorescent lamps while maintaining reasonable levels of light output and efficacy. Prior art fluorescent lamps were generally operated from line current sources in conjunction with inductive and/or resistive auxiliary ballast components. Recently developed electronic power supply and current-limiting circuits are available as replacements for heavy, expensive prior art inductors and transformers, and have made the operation of short fluorescent lamp tubes at high current and low voltage economically feasible. In order to obtain reasonable efficacy from an arc discharge column at high current, it is necessary to operate with a fill gas which comprises a large percentage of light, inert gas atoms, i.e., neon; at low pressure, i.e., below 3 torr.

Conventional filament electrodes perform poorly at ac currents in excess of 2 amperes. Filament electrodes are characterized by a cathode spot which, at high currents, becomes very intense and tends to cause rapid evaporation and loss of active emission material. At the same time, the electrode voltage drop rises with increasing current as the cathode spot is depleted of emission material. Electrode damage and high voltage drop is a particularly severe problem in a low pressure neon-mercury vapor fill gas inasmuch as neon has a small atomic cross section and thus allows a more rapid diffusion loss of evaporated cathode material and mercury ions in the discharge.

It is well known that hollow cathodes present an attractive alternative to filament cathodes in high current fluorescent lamps. Properly designed hollow cathodes emit diffusly from a relatively large area; that is, they do not emit from a small hot cathode spot; have a low cathode fall voltage; and tend to contain evaporated emission material within a hollow cavity. U.S. Pat. No. 3,883,764 to Peter D. Johnson and John M. Anderson describes a cylindrical hollow cathode which surrounds a conventional filament cathode. The filament aids in starting the discharge and dispenses emission material to the inner surface of the cylindrical hollow cathode.

SUMMARY OF THE INVENTION

A discharge electrode comprises a hollow cathode in the form of a truncated cone which surrounds a conventional filament cathode. The narrow end of the cone is directed toward the discharge to constrict the discharge path from the filament and, thus, functions to speed the transition from a hot spot starting mode to a diffuse hollow cathode operating mode. The conical cathode structure is more rigid than prior art cylindrical structures and may, therefore, be constructed from thinner materials which necessarily have lower thermal inertia and are less subject to heat conduction losses. The structure provides an ample space for the internal filament, yet permits optimization of the hollow cathode tip diameter. The narrow discharge opening further acts to reduce diffusion losses of eroded electrode material through the fill gas.

It is, therefore, an object of this invention to provide discharge electrodes which act to speed the transition from a spot discharge mode to a diffuse discharge mode;

Another object of this invention is to provide discharge lamp electrodes having an optimum tip diameter;

Another object of the invention is to provide a rigid electrode structure with low thermal conductivity and low thermal inertia;

Another object of this invention is to provide discharge electrodes which are suitable for use in low pressure, low atomic weight gases;

Another object of this invention is to reduce the loss of eroded electrode material from discharge lamp cathodes.

BRIEF DESCRIPTION OF THE DRAWINGS

The novel features believed characteristic of the present invention are set forth in the appended claims. The invention itself, together with further objects and advantages thereof, may best be understood by reference to the following detailed description, taken in connection with the appended drawings in which:

DESCRIPTION OF THE PREFERRED EMBODIMENTS

Figure 1:
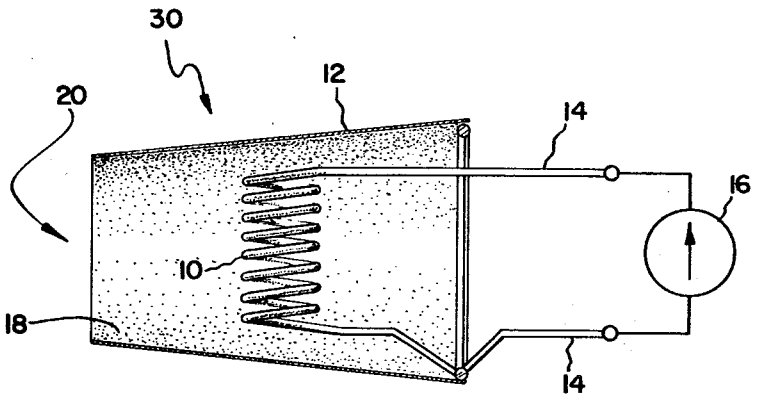
FIG. 1 is a discharge electrode of the present invention.

FIG. 1 is an improved discharge cathode of the present invention. An emissive-oxide coated filament 10 is disposed within a hollow, truncated, conical cathode structure 12. The filament 10 is supported on metal rods 14 which are connected across a current source 16 which functions to supply electrical energy for heating the filament. One of the support rods 14 may, if desired, be bonded to the conical cathode structure 12 to support the filament 10 therewithin. The inner surface of the hollow cathode 12, or portions thereof, may be coated with emissive material 18 which may be the same material utilized on the filament 10. By way of example, the emissive material may comprise a commercial triple oxide emissive mix which includes the oxides of barium, calcium, and strontium. Alternately, the emissive material may be any other well-known emissive materials which, for example, include the alkali earth oxides, the rare earth oxides, and the oxides of thorium, yttrium, zirconium, hafnium, and tantalum. The filament 10 material is not critical and may include any of the materials commonly used for such purposes in the discharge lamp art, for example, tungsten, tantalum, or rhenium. The conical hollow cathode 12 is, optimally, constructed from a refractory metal foil which is compatible with discharge lamp gases and which is characterized by negligible vapor pressure at operating temperatures from approximately 1000° to approximately 1300° C. By way of example, the conical cathode 12 may comprise molybdenum, nickel, tungsten, or rhenium foil with a preferred thickness between approximately 0.005 mm and approximately 0.05 mm.

The narrow end 20 of the conical cathode 12 is directed towards the arc discharge and, in a typical fluorescent lamp which operates from an alternating current source, alternately functions as a cathode and an anode. Optimally, the diameter of the narrow end is between approximately 4 mm and approximately 20 mm. The discharge is initiated by a preheat, starting circuit which first applies current to heat the filament 10 and, subsequently, simultaneously removes filament current and applies voltage across the discharge path. The discharge first terminates at a spot on the filament 10 and then rapidly transitions to a diffuse discharge from the narrow end of the cone 20.

By way of example, electrodes of the present invention were constructed utilizing a conventional fluorescent lamp filament disposed within a truncated cone element of 0.012 mm thick molybdenum foil. The cone element 12 had an overall length of 20 mm and a 16° included angle. The narrow end 20 of the cone was approximately 8 mm in diameter and the wide end of the cone was approximately 14 mm in diameter.

The electrodes were tested in a 5 cm diameter arc tube containing a neon/mercury mixture with 30 KHz ac currents up to 5 amperes. Compared to cylindrical electrodes of similar construction, the electrodes of the present invention transferred more rapidly from a hot spot mode to a hollow cathode, diffuse mode. The transfer is marked by the disappearance of a filament hot spot. At high current levels, i.e., 4 and 5 amperes RMS, the cathode voltage drop of electrodes of the present invention is approximately 10 percent lower than the voltage drop of equivalent cylindrical hollow cathodes-filament combinations. At current levels of approximately 1 ampere, the cathode voltage drop is, however, greater than that of a cylindrical cathode.

Figure 2:
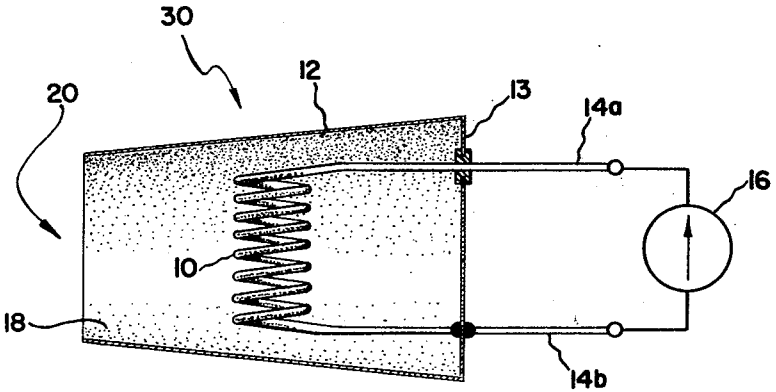
FIG. 2 is an alternate embodiment of the electrode of FIG. 1.

FIG. 2 is an alternate embodiment of the electrode of FIG. 1 wherein the wide end of the conical cathode structure 12 is substantially closed off with a metal foil disk 13. One of the filament leads 14*a* penetrates and is insulated from the disk 13 while the other filament lead 14*b* is bonded to the cathode structure. The metal disk 13 functions to reduce back-arcing from the cathode structure.

Figure 3:
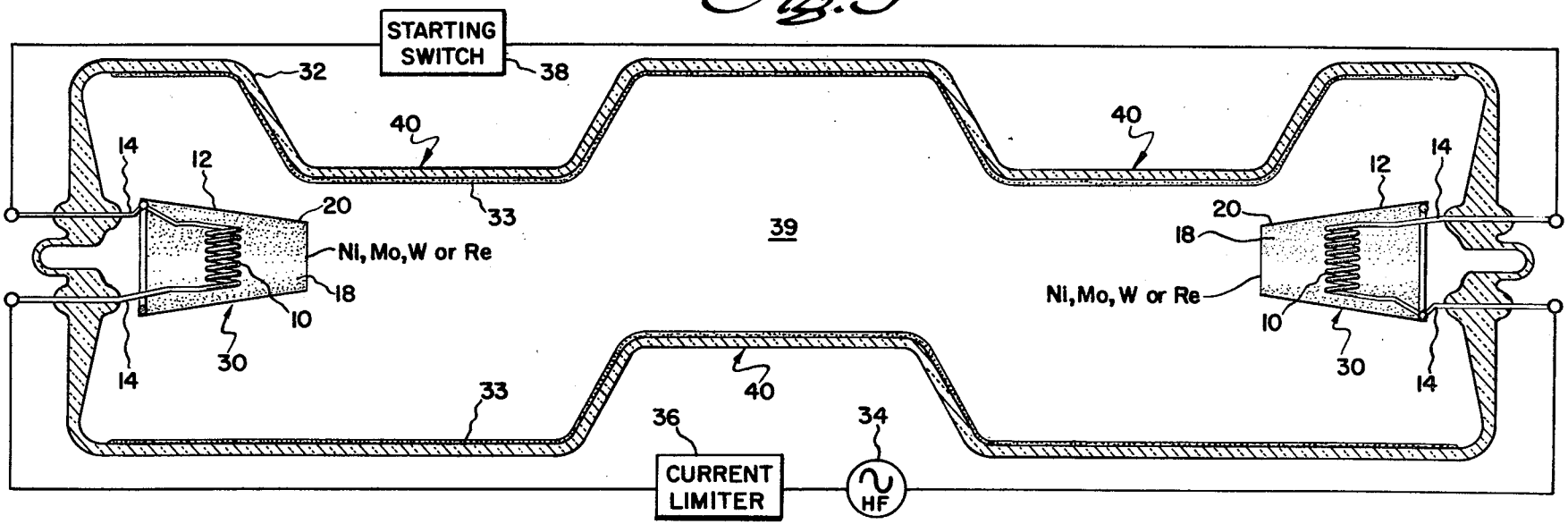
FIG. 3 is a high current, short-arc fluorescent lamp which includes the electrodes of FIG. 1.

FIG. 3 is a compact fluorescent lamp which includes electrodes of FIG. 1. The electrodes 30 are mounted at opposite ends of a tubular glass envelope 32, and are supported on leads 14 which sealably penetrate the ends of the envelope 32. The internal surface of the envelope is coated with a fluorescent phosphor 33. A high frequency current source 34 and current-limiting means 36 are connected in series between the electrodes. Typically, the current source 34 may comprise a high frequency, solid state inverter circuit. It is known that the anode voltage drop in arc tubes decreases with frequency for alternating current frequencies below approximately 2000 Hz. The anode voltage drop appears to remain constant with frequency above approximately 2000 Hz. The frequency of operation for the high frequency current source 34 should, therefore, be above approximately 2000 Hz. Ideally, the frequency of the source 34 should be above the audible range, that is, above approximately 25 kHz to minimize vibrations and acoustic radiation from the tube. The current limiter means 36 may, if desired, comprise inductive or resistive ballast components or may, alternately, comprise electronic current regulating circuits which may be intimately associated with the high frequency current source 34. The filaments 10 in each of the electrodes are connected in series with each other and with the current-limiting means 36 and high frequency current source 34 through a starting switch 38. Typically, the starting switch is of a preheat type, which is initially closed and which opens after a short time delay, thereby disconnecting the filament circuit and applying the operating voltage between the electrodes at opposite ends of the tube. Alternately, any of the other means and circuits commonly employed for starting fluorescent lamps may be utilized. Such circuits are described, for example, in *Electric Discharge Lamps* by John F. Waymouth, (MIT Press, 1971) at Chapter 3.

The tube is filled with a low pressure gas 39 which may, for example, comprise mercury vapor at a pressure of 8 microns and either pure neon or a mixture of approximately 80 percent neon with approximately 20 percent argon. Ideally, the tube is formed with alternating indentations 40 in opposite walls which tend to lengthen the arc path and raise the local electron temperature in a manner described at page 33 of the Waymouth book.

As an example and to permit others to more easily practice the invention, a typical lamp of FIG. 3 is constructed from 5 cm diameter Nonex® glass, approximately 26 cm long and containing three indentations 40. The tube is coated on the inside with fluorescent phosphor 33 and contains a gas 39 comprising 2 torr of pure neon saturated with mercury vapor. After 8 hours of operation from a 30 kHz power source, the tube produced approximately 1900 lumens at 40 watts power input and approximately 3400 lumens at 80 watts power input; a relatively high efficacy for lamps of this size.

Electrodes of the present invention enable high efficiency operation of high current electric discharges in low pressure, low atomic weight, gas environments. The discharge starts as a spot mode on the heated filament and rapidly shifts to a diffuse mode discharge from the small end of the conical electrode. Cathode voltage drop and sputtering of emission material from the cathode surface are reduced as compared to prior art cylindrical cathode structures. Cathodes of the present invention thus enable production of high efficacy, short-arc fluorescent lamps.

While the invention has been described in detail herein in accord with certain preferred embodiments thereof, many modifications and changes therein may be effected by those skilled in the art. As an example, the electrodes of the present invention allow much flexibility in design to suit particular operating conditions. For example, the narrow end of the truncated cone may be much smaller in diameter for operation with low currents and high fill gas pressures, or larger for operation with high currents and low pressures; the filament may be moved close to the narrow end for operation at low currents or further back into the cone for operation at high currents; and the inner surface of the truncated cone may receive emission material by evaporation, sputtering and diffusion from the filament during discharge operation, rather than being initially coated. Accordingly, it is intended by the appended claims to cover all such modifications and changes as fall within the true spirit and scope of the invention.

The invention claimed is:

1. In an electrode structure, which includes an improved cathode for an electric discharge emanating from substantially a single direction, comprising:

a refractory metal cylinder, open at both ends and having inner and outer surfaces; and an emissive mix coated filament centrally disposed within said cylinder; the improvement wherein said cylinder comprises a truncated conical structure having a wide end and a narrow end with the narrow end thereof directed toward the electric discharge, whereby a transition, from a termination of the electric discharge on the filament, to a termination of the electric discharge on the cylinder, is hastened.

2. The electrode of claim 1 further comprising an electron-emissive material disposed on the inner surfaces of said cylinder.

3. The structure of claim 1 wherein the apex angle of said conical structure is between 4° and 90°.

4. The electrode of claim 2 wherein said refractory metal cylinder is selected from the group consisting of molybdenum, nickel, tungsten, and rhenium.

5. The electrode of claim 2 wherein said cylinder comprises a foil having a thickness between approximately 0.005 mm and approximately 0.05 mm.

6. The electrode of claim 2 wherein said truncated conical structure has a narrow end with a diameter between approximately 4 mm and approximately 20 mm.

7. The structure of claim 1 further comprising a disk of metal foil, disposed across and substantially closing off the wide end of said conical structure.

8. A fluorescent lamp comprising:

a substantially tubular, light-transmissive, evacuable envelope having two ends;

a fill gas contained within said envelope;

at least one electrode structure disposed at each end of said envelope, said electrode structure comprising a truncated conical, refractory metal cylinder open at both ends and having a wide end and a narrow end with the narrow end directed substantially toward the end of said tubular envelope opposite that end in which said electrode structure is disposed, said electrode structure also possessing an emission mix coated filament centrally disposed within said cylinder; and means for establishing and maintaining an electric discharge between said electrode structures.

9. The lamp of claim 8 wherein said envelope comprises a glass tube having side walls defining alternating indentations.

10. The lamp of claim 8 wherein said fill gas comprises, as a major fraction, neon and further comprises saturated mercury vapor.

11. The lamp of claim 10 wherein the vapor pressure of said neon is less than approximately 3 torr.

12. The lamp of claim 10 wherein said means for establishing and maintaining said discharge include a high frequency power source connected between said electrode structures.

13. The lamp of claim 12 wherein said high frequency power source operates at a frequency greater than or equal to approximately 25 kHz.

14. The lamp of claim 13 wherein said means for establishing and maintaining said discharge further include a preheat starting circuit connected in series with the filament of said electrode structures.

* * * * *